United States Patent [19]

Pontes et al.

[11] 4,433,814

[45] Feb. 28, 1984

[54] CORE-ENGAGER RETAINER FOR AN EXPANSIBLE SHAFT

[75] Inventors: Virgil M. Pontes, N. Dighton; Lawrence C. Young, South Easton, both of Mass.

[73] Assignee: Double E Company Inc., Brockton, Mass.

[21] Appl. No.: 485,111

[22] Filed: Apr. 14, 1983

[51] Int. Cl.[3] ..... B65H 75/24

[52] U.S. Cl. ..... 242/72.1; 242/46.4

[58] Field of Search ..... 242/72.1, 72 R, 68.2, 242/46.2, 46.3, 46.4; 279/2 R, 2 A

[56] References Cited

U.S. PATENT DOCUMENTS

| | | | |
|---|---|---|---|
| 2,345,246 | 3/1944 | Elka | 242/72.1 |
| 3,331,565 | 7/1967 | Gerritts | 242/72.1 |
| 3,430,883 | 3/1969 | Charneski et al. | 242/72.1 |
| 3,934,836 | 1/1976 | Dunlap et al. | 242/72.1 |
| 4,105,172 | 8/1978 | Petros | 242/72.1 X |
| 4,254,920 | 3/1981 | Peterson | 242/72.1 |

*Primary Examiner*—Stanley N. Gilreath

[57] ABSTRACT

An expansible shaft in which an axially-movable cam forces a core engager radially outward into engagement with a surrounding core. A cam follower attached to the core engager slidingly engages a cam surface of the cam, a recessed slot is parallel to the cam surface, and one end of a cross-bore in the cam follower overlies and follows the slot as the cam follower slides along the cam surface. A second bore perpendicularly intersects the cross-bore. A first member is mounted in and forms a slip-fit with the cross-bore, a second member is mounted in the second bore, and the length of the first member is such that a portion of it projects into the slot when the second member is within the bore intersection, but the entire first member fits within the cross-bore when the second member is withdrawn from the bore intersection.

14 Claims, 10 Drawing Figures

CORE-ENGAGER RETAINER FOR AN EXPANSIBLE SHAFT

BACKGROUND OF THE INVENTION

This invention relates to expansible shafts.

Such shafts have an axially extending housing and a core engager which moves radially from a retracted position within the housing to an expanded position in which the core engager extends beyond the outer housing wall. For example, Peterson U.S. Pat. No. 4,254,920 (assigned to the assignee of this application) discloses a fluid-actuated shaft having an operating rod that is mounted co-axially with and moves axially relative to the housing. Springs move the actuators to force the core-engagers radially outwardly into engagement with a surrounding core and a fluid-activated piston drives the operating rod in the other direction to retract them.

One system for coupling the rod and core engagers is shown in, and described with reference to, FIGS. 6–9 of the related applications of Messrs. Pontes, Flagg and Young cited hereinafter. As there shown, the core engagers are attached to radially extending cam-followers which terminate in cam-follower surfaces that are inclined with respect to the shaft axis. The actuator has cam surfaces parallel to, and in contact with the follower surfaces. Rolled steel pins extend through lateral openings to bores in the cam followers and engage grooves in the actuators parallel to the cam surfaces. This arrangement has proved to present practical operational problems; in particular it has not proved as strong as desirable and has been difficult to disassemble for repair.

CROSS-REFERENCE TO RELATED APPLICATIONS

The preferred embodiments described herein; include several features which were invented prior to or substantially concurrently with the present invention. Many of these features are the subject of other applications, copending with the present application, assigned to the assignee of the present application, and titled as follows:

- Ser. No. 470,142, filed Feb. 28, 1983 entitled EXPANSIBLE SHAFT WITH ACTUATOR RETAINING MEMBER AND SPHERICAL BEARING SURFACE, filed in the name of Virgil M. Pontes, one of the inventors herein;
- Ser. No. 470,145, filed Feb. 28, 1983 entitled MECHANICAL EXPANSIBLE SHAFT, filed in the name of R. Edward Flagg; and
- Ser. No. 470,143, filed Feb. 28, 1983 entitled POSITIVE RETRACTING MECHANICAL EXPANSIBLE SHAFT, filed in the name of Lawrence C. Young, one of the inventors herein.

The features which are the subject of the first two of the above-listed applications were invented prior to the present invention.

SUMMARY OF THE INVENTION

The invention features an expansible shaft in which an axially-movable cam forces a core engager radially outward into engagement with a surrounding core. A cam follower attached to the core engager slidingly engages a cam surface of the cam, a recess or slot is provided parallel to and at one side of the cam surface, and one end of a cross-bore in the cam follower overlies and follows the slot as the cam follower slides along the cam surface. A second bore in the cam follower perpendicularly intersects the cross-bore. A first member is mounted in and forms a slip-fit with the cross-bore, a second member is mounted in the second bore, and the length of the first member is such that movement of the second member into the bore intersection forces a portion of the first member to project from the cross-bore into the slot, but the entire first member will fit within the cross-bore when the second member is withdrawn from the bore intersection. The end of the first member engaging the second member is convex, preferably hemispherical; and the intersecting surfaces of the slot and other end of the first member are such that, when the cam follower is moved generally perpendicularly to the slot, interaction between the two surfaces forces the first member to slide back into the cross-bore.

In preferred embodiments, the cross-bore extends through the width of the cam follower, a slot (convex curved in cross-section) is provided adjacent each end of the cross-bore, a circular-in-cross-section first member is provided on each side of the second bore and is arranged to project into the slot a distance in the range of about ½ to the radius of the first member, and the second member includes a set screw threaded into the second bore.

DESCRIPTION OF THE PREFERRED EMBODIMENTS

First, the drawings are briefly described.

Drawings

Structure

Figure 1:
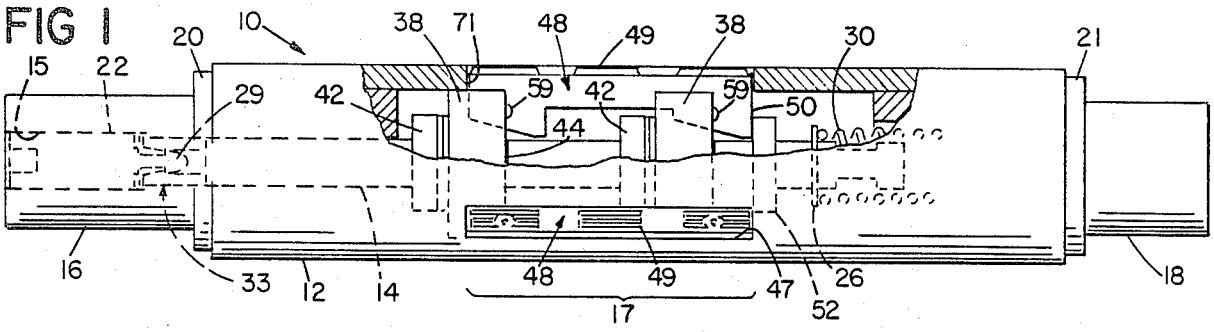
FIG. 1 is a perspective view, partially broken away, of a first expansible shaft showing the engaging sections retracted.

Referring now to FIGS. 1–5, expansible shaft 10 is formed from a hollow cylindrical outer housing 12, which is generally co-axial with, and surrounds, a central operating rod 14. Mounting arbors or journals (16 and 18) are fitted partially within the opposite ends of housing 12, and include respective impact collars 20, 21 which engage the opposite axially-facing ends of the housing. In the embodiment shown, shaft 10 includes one core engagement section 17, substantially centered along the length of the shaft.

Figure 5:
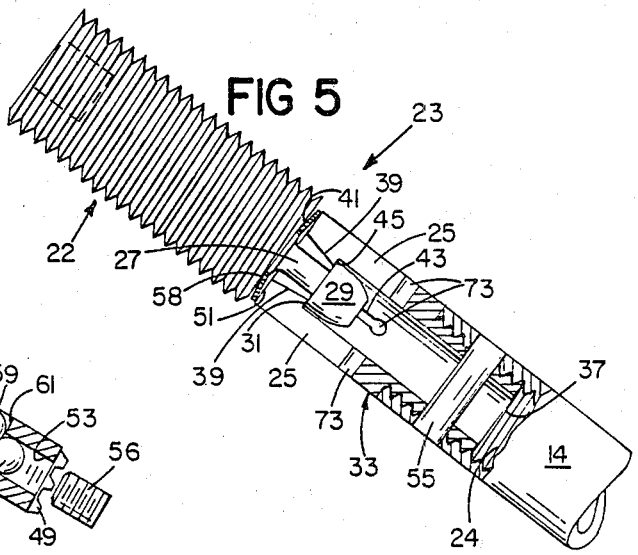
FIG. 5 is an enlargement, partially in section, of components of the shaft of FIG. 1.

A cylindrical bore 15 extends coaxially through journal 16. The outer (left as seen in FIG. 1) half of bore 15 is threaded and engages the outer, co-operatively threaded surface of drive screw 22 of rod-actuator 23. As best shown in FIG. 5, rod-actuator 23 comprises, in addition to drive screw 22, a socket 33 flexibly attached to screw 22 as described below.

A connecting shaft 27 protrudes coaxially from the axially inward end 51 of drive screw 22, and terminates at its inward end in a generally mushroom shaped head 29. The outer end of head 29 includes a flat annular surface 31 perpendicular to the axis of shaft 27 and facing towards screw 22. The diameter of connector shaft 27 is about 1/16 inches less than the maximum diameter of head 29; thus, the difference between the inner and outer diameters of surface 31 is 1/16 inch.

Socket 33 is a hollow cylinder, one end of which is threaded and engages operating rod 14 and the other end of which is snapped around connector shaft 27 and head 29. As shown, four slots 43 extend through the wall of socket 33 and extend axially from the outward end 41 of socket 33 to about midway its length, terminating in stress-relieving drilled holes 73. Slots 43 are equally spaced and provide four stiff fingers 25, each subtending an arc of about 90°. At the end of each finger 25 nearest end 41 is a radially inward projection 39, the inner surface of which is beveled outwardly toward end 41 and the axially inner end of which defines an annular step 45. Projections 39 of fingers 25 are sized so that the projections snap over head 29, providing clearance with the periphery of shaft 27 but with annular steps 45 engaging the sides and end 31 of head 29. When the socket 33 end screw 22 are so snapped together, the adjacent ends 51, 41 are closely adjacent, but not in contact with, each other. A belleville spring washer 58 is seated, in slight compression, in the gap between end 41 of socket 33 and the axially inward end 51 of the threaded section of drive screw 22, and biases the screw 22 and socket 33 axially apart. As will be evident, the screw and socket are free both to rotate, and slightly to pivot axially, with respect to each other.

In assembly, head 29 is axially forced past projections 39 of fingers 25. The outer surface of head 39 forces fingers 25 radially outward until head 29 clears the ends of projections 39, at which point the fingers snap into postion behind it.

As indicated, the axially inner end 37 of socket 33 is externally threaded and engages a co-operatively sized and threaded cylindrical cavity 24 in the end of rod 14. Once screw 22 and socket 33 have been snapped together, the entire actuator 23 is screwed into rod 14, a hole is drilled radially through the theaded together end 37 and rod 14, and a pin 55 is driven through the hole to hold everything tightly in place.

Operating rod 14 extends centrally from its end cavity 24 engaging socket 33, along the axis of housing 12 to a cylindrical recess 70 in the journal 18 at the far end of shaft 12. As shown, a travel adjusting cap screw 32 is threaded coaxially into the end 19 of rod 14 and is there held in place by jam nut 28. Jam nut 28 also holds stop washer 26 tightly in place against the rod end. A helical spring 30 is mounted within recess 70 and coaxially surrounds cap screw 32. One end of the spring engages a thrust washer 36 and belleville spring washer 34 (Associated Spring Co. Catalog No. 61125-053) at the base of cavity 70; the other end of the spring engages stop washer 26.

Each core engaging section 17 includes two axially-spaced spider cams 38, each of which is mounted coaxially on rod 14, and three circumferentially-spaced, axially-extending core engages 48, each of which extends through a respective radially-extending opening 71 in the cylindrical wall of housing 12. The spider cams 38 are identical to each other, and each defines three circumferentially-spaced, inclined cam surfaces 40. In the illustrated embodiment, cam surfaces 40 are inclined at an angle (measured relative to the axis of rod 14 and, as shown in FIG. 2, inclined downwardly from the end 35 of the cam 38 nearer drive screw 22) of about 13°; and the cam surfaces, core engager unit 48, and openings 71 are all spaced at 120° intervals around the axis of the shaft.

Each spider cam 38 is mounted between a shaft collar 42 (at end 35 of the spider cam 38) and a retainer ring 44 (at the other end 72 of the cam). Two belleville spring washers 46 (Associated Spring Co. Catalog No. B1500-060) are mounted in series between and engaging collar 42 and cam end 35.

Figure 2:
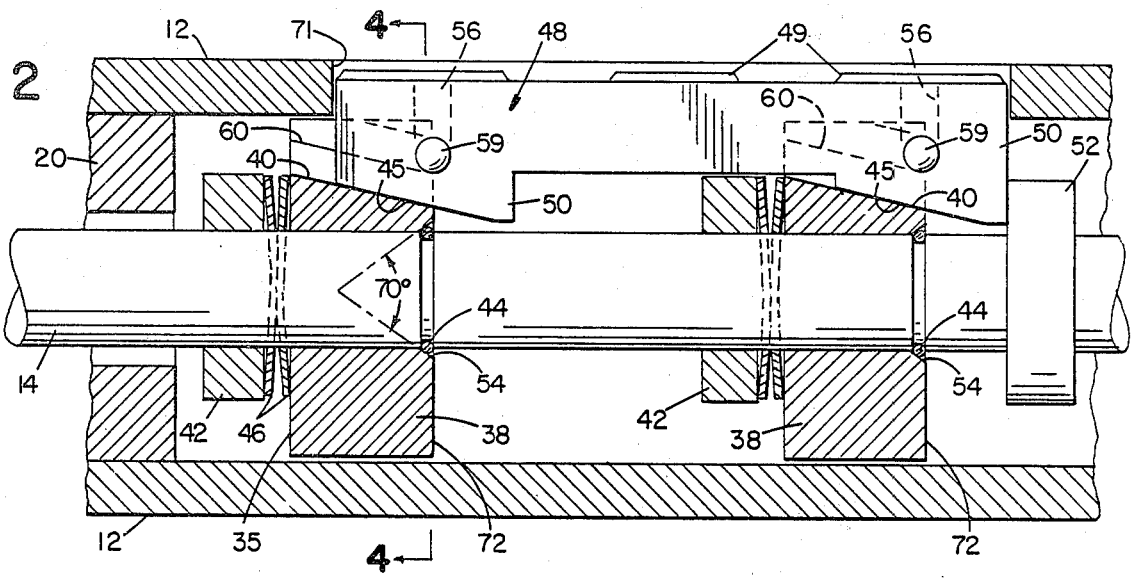
FIG. 2 is an enlargement of a portion of FIG. 1, with all core-engagers except one removed for clarity.
Figure 3:
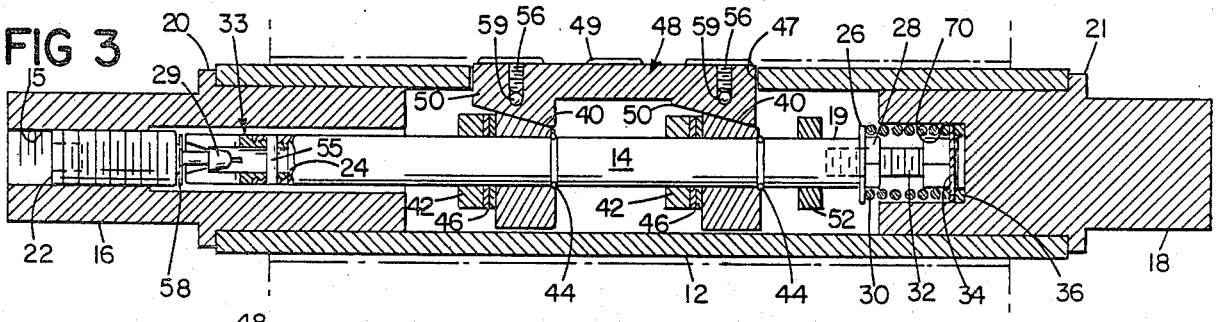
FIG. 3 is a lateral cross section of the shaft of FIG. 1 showing the core-engaging sections extended.

As shown most clearly in FIG. 2, each core engager 48 is an integral metal unit that includes a number of spaced core engaging lugs 49 on its radially outer surface, and a pair of axially-spaced radially inwardly extending cam-followers 50, each of which defines a sloped cam surface 45 arranged to engage a respective cam surface 40 of a spider cam 38. A shaft collar button stop 52 is attached to rod 14 adjacent the end 72 of the spider cam 38 farther from drive unit 22. Stop 52 is positioned on rod 14 such that it will engage the axial end of a cam follower 50 and limit travel of rod 14 towards drive screw 22.

As shown in FIG. 2, a countersink (70° included angle) around the central opening of each spider cam 38 at its end 72 defines an annular surface 54 which is inclined radially outward (as shown at an angle of 35° relative to the axis of the shaft) toward retainer 44, and which contacts and is sufficiently deep entirely to receive and overlie retainer 44. Retainer 44 is a discontinuous ring 0.062 inches in diameter, seated in a groove 1/32 inch deep (i.e, about half the ring diameter) in rod 14.

Figure 4:
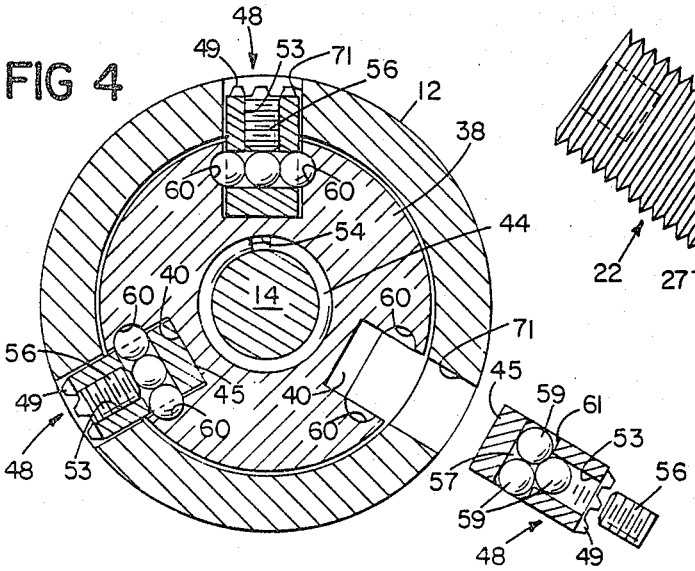
FIG. 4 is a cross section taken along 4—4 of FIG. 2.

Also shown in FIG. 4 is the structure which couples cam-followers 50 to spider cams 38. Each cam-follower 50 has a threaded central radial bore 53 about 0.210 inch in diameter, which joins at its radially inward end intersects a cross-bore 57, also about 0.210 inch in diameter. Cross-bore 57 extends through cam follower 50, and its end openings 61 have been narrowed to about 1/16 inch diameter by peening over the ends of the cross-bore. Guide slots 60 are provided in spider cams 38, on each side of, parallel to, and slightly above each cam surface 40. The end openings 61 of cross-bore 57 overlie slots 60 as the cam followers 50 slide along cam surfaces 40. Each cam follower 50 is about ½ inch wide; and each slot 60 is about 1/16 in. deep. As shown, cam followers 50 are held in place in spider cams 38 by three metal balls 59, each 0.208 in. in diameter. When the cam followers 30 are seated on cam surfaces 40, all three balls 59 will fit side-by-side in bores 57, with the outer portion of a ball fitted within each of guide slots 60. A screw 56, inserted in each bore 53, presses down on the centrally located ball and holds it in place in alignment with the two side balls 59. As will be seen, the distance of each of the two side balls 59 extends through a respective opening 61 into the respective guide slot 60 associated with that opening is less than the ball radius and, preferably is about ½ the ball radius.

In assembly, the balls are inserted into a bore 53, when the cam-followers 50 are at least partially in place. When the cam follower cam surfaces 45 are fully seated on cam surfaces 40, screw 56 is tightened down on the center ball, insuring that the two side balls 59 are forced outwardly into guide slots 60, thus anchoring the core follower member in place on the spider cam.

For disassembly, screw 56 is partially withdrawn from the cam follower 50 so that the center one of side balls 59 is free to move radially outwardly into central bore 59 and thus permit the two side balls 59 to withdraw wholly into cross-bore 57. When the screw 56 has been so withdrawn, cam engager 48 is pulled radially outwardly, and the interaction between slots 60 and the two side balls 59 forces those two balls into the cross-bore. Generally, the cam engager will be removed while upside down so that the center ball simply drops into central bore 53.

OTHER EMBODIMENTS

FIGS. 6–9 show an alternate shaft 110, essentially similar to that of FIGS. 1–5, but having a different method of coupling the actuating screw to the central rod and showing multi-piece core-engagment members. To the extent that elements in FIGS. 6–9 correspond to their counterparts in FIGS. 1–5, those elements have been given corresponding numbers.

Figure 6:
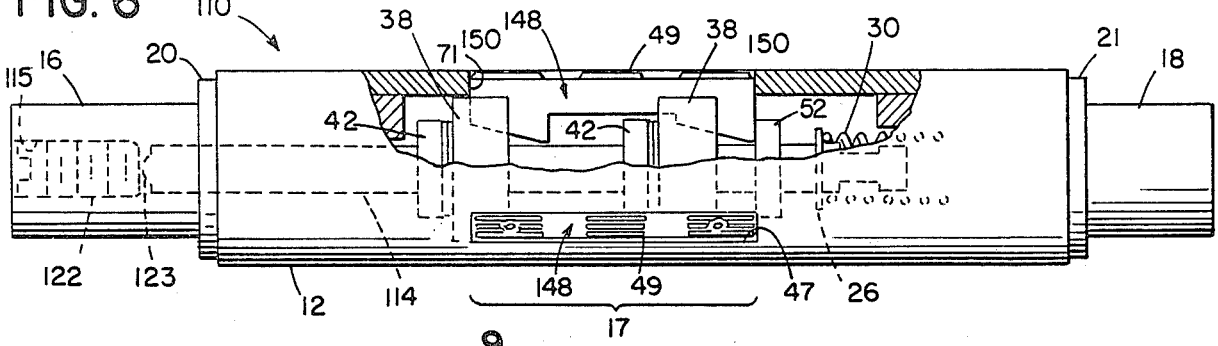
FIG. 6 is a perspective view, partially broken away, of a second shaft showing the core-engaging sections retracted.
Figure 7:
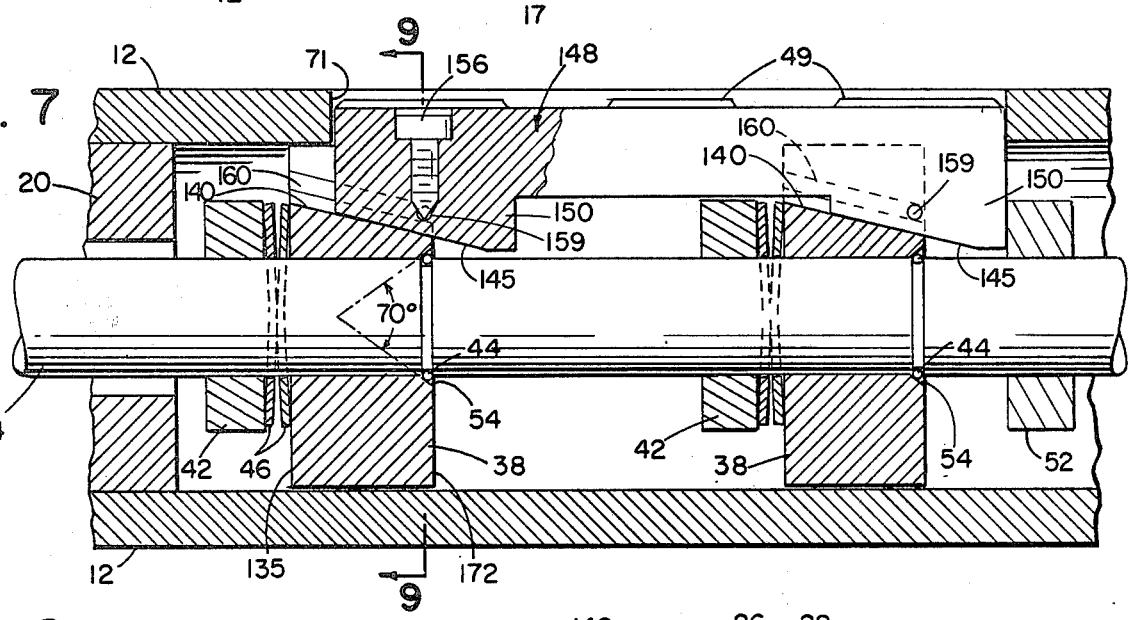
FIG. 7 is an enlargement of a portion of FIG. 6, with all core-engagers except one removed for clarity.
Figure 8:
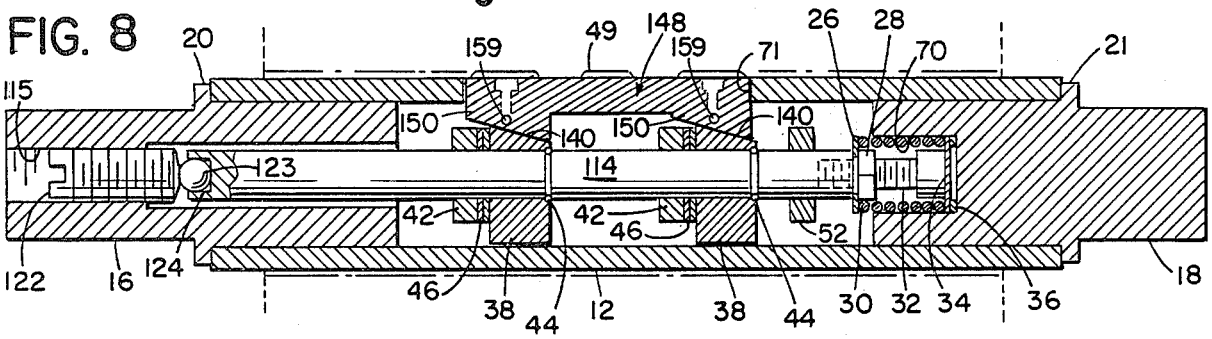
FIG. 8 is a lateral cross section of the shaft of FIG. 6 showing the core-engagers extended.

Turning first to the system for coupling the actuating screw 122 to rod 114, as shown in FIGS. 6–9 a threaded cylindrical cavity 115 extends coaxially through journal 16. The outer (left as seen in FIG. 6) half of cavity 115 is threaded and engages an activating screw 122, which in turn abuts ball bearing 123 seated in a cavity 124 in the adjacent end of rod 114. Cavity 124 has a depth slightly greater than the radius of bearing 123, and surrounding portions of the cavity lip are peened over to overlap the bearing surface and hold it in place within the cavity. Operating rod 114 extends axially from adjacent activating screw 122 along the axis of housing 12 and is seated in cylindrical recess 70 as described above with reference to the embodiment of FIGS. 1–5.

Figure 9:
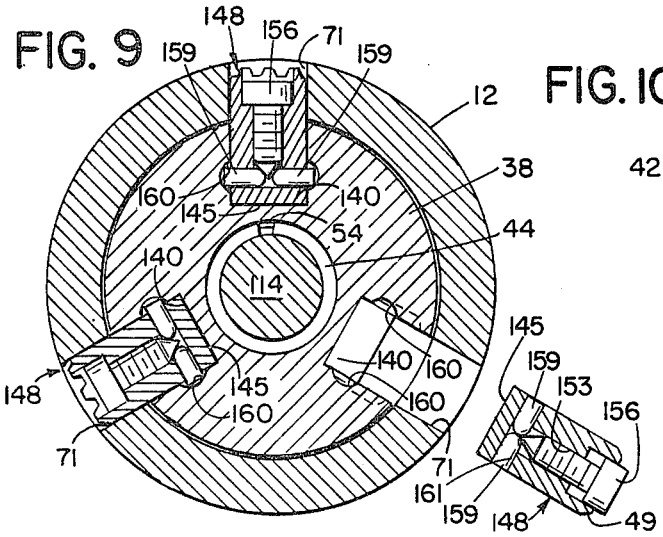
FIG. 9 is a cross section taken along 9—9 of FIG. 7.

The core-engagers of the FIGS. 6–9 embodiment are shown most clearly in FIG. 9. Axially-spaced cam followers 150 extend radially inwardly from the underside of each core engager 148, adjacent the opposite ends thereof. The inwardly-facing end of each cam follower 150 defines a sloped cam surface 145 arranged to engage a respective cam surface 140 of spider cam 138. Set screws 156 (each about ⅛ in. diameter) are recessed in core engagers 148 and extend radially inwardly into threaded central bores 153. Central bore 153 intersects at its inner end with a cross-bore 157, which is slightly over ⅛ in. in diameter. Two solid steel rods 159, each ⅛ in. in diameter (to form a slip-fit with the bore) and ¼ in. long, are fitted in each cross-bore 157, one on each side of central bore 153. The inner ends 161 of rods 159 are hemispherical; the outer ends are flat and fit into respective guide slots 160 in spider cam 138.

As in the previously described embodiment, a slot 160 is provided parallel to, slightly above, and on each side of each cam surface 140. Slots 160 are curved in transverse cross-section, the sides and base of the slot being defined by a circular arc having a radius of 0.093 in. (i.e., greater than that of the steel rods 159) and an arc height of a little over 1/16 inch (so that each rod 159 will project about 1/16 in. into a slot).

Before assembly of core engagers 148 to the spider cams 138, each steel rod 159 is fitted entirely within a respective cross-bore 157, with the outer end of the rod flush with the side of cam follower 150, and the inner end of each pin extending to about the center of the intersection of cross-bore 157 and central bore 153. Screws 156 are positioned in central bores 153 above rods 159, except for the conical end of the screw which may lightly engage the adjacent ends of rods 159. Screws 156 are then tightened, and their conical ends force rods 159 in cross-bore 157 outwardly, through the lateral openings 161 at the ends of the cross-bore and into slots 160, thus anchoring the cam-follower/engaging-member assembly in the spider cam slots. For disassembly, screws are simply withdrawn. Core engagers 148 may then be pulled (e.g., manually) radially outwardly; and the reaction between curved base of slot 161 and the engaged end of the respective rod 159 will move the pins inwardly into cross-bores 157.

Figure 10:
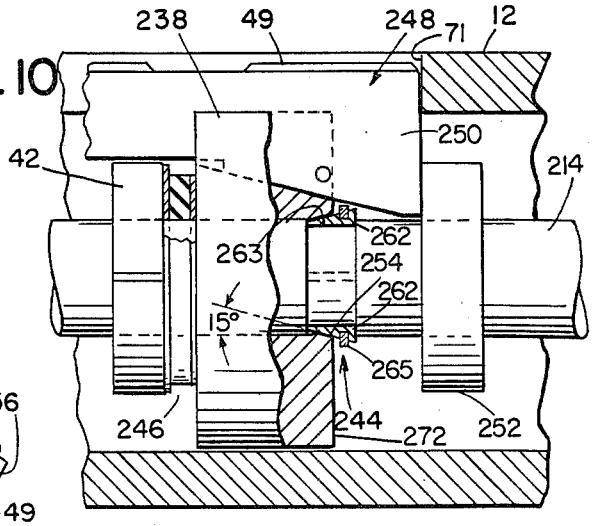
FIG. 10 is a cross section of a portion of a third shaft showing a conical core-enganging-actuator retaining member.

Finally, FIG. 10 shows a third shaft, similar in most respects to the shafts of FIGS. 1–9, but using a frusto-conical retaining collar 244 in place of retaining ring 44, and also having an elastomer cam spring 246 rather than belleville washers 46. Collar 244 comprises an annular ring, the outer surface of which is inclined at an angle of 15° to its axis, cut into two halves 262. Each collar half 262 is seated in a 1/32 inch deep groove 263 in rod 214, and the inner diameter of the ring from which halves 262 are cut is substantially equal to the outer diameter of the grooved portion 263 of the rod. The two halves are held in place by a Spirolox-brand spring ring 265 which surrounds them and is seated in a 1/32-inch deep groove in the outer surfaces of collar halves 262. As shown, the countersink at end 272 of the spider-cam-engaging collar 244 has an included angle of 30° (i.e., annular surface 254 is inclined at an angle of 15°) to mate smoothly with the collar. The depth of the countersink is such that it will receive and engage about half of collar 244.

Elastomer cam spring 246 comprises a pair of steel washers 245, 247 bonded to the opposite ends of a 60 durometer polyurethene annular core. The core is 0.250 in. thick; the overall thickness (i.e., axial length) of spring 246 is 0.312 in. The washer 245 engaging collar 42 is 1.500 in. in diameter; the diameter of washer 247 is 1.375 in.

Other embodiments will include a plurality of axially-spaced core engagement sections 17, the particular number of sections included in any particular shaft depending largely on the axial length of the core the shaft is intended to support. In shafts with multiple core engagement sections, adjacent sections may be aligned or they may be circumferentially staggered with respect to each other so that the shaft housing openings 71 of the adjacent sections are not axially aligned (e.g. are displaced 60° with respect to each other). Additionally, each spider cam (except the two end cams) may support the cam followers of the core engagers of two longitudinally adjacent core engagement sections, in which case the internal spider cams will each have six cam surfaces spaced 60° apart, and the core engagers of the two adjacent engagement sections will be coupled to alternate cam surfaces on a given spider cam.

Operation

FIG. 1 shows the shaft with core engagers 48 in the retracted position. Drive screw 22 is withdrawn (to the left as shown), and the rod 14 is biased towards the drive screw 22 by return spring 30. The extent to which rod 14 is free to move to the left is limited by stop 52, which, as shown in FIG. 2, abuts the side of a cam follower 50 preventing further rod movement. In the fully-retracted position, the cam engagers 48 are at their radially inner-most position, with lugs 49 flush with or slightly within the cylindrical outer surface of housing 12, and the cam follower cam surfaces 45 engage the lower (radially inner) ends of spider cam surfaces 40. Retainer rings 44 couple cams 38 to rod 14, ensuring movement of the cams as the rod is moved. The distance between stop 52 and the retainer ring 44 of the adjacent cam 38 is less than the axial length of cam followers 50, thereby preventing the cam followers from sliding off cam surfaces 40.

To extend core engagers 48 past the perimeter of housing 12 so that they will engage the core of a roll placed on the shaft, drive screw 22 is tightened (i.e., rotated clockwise, moving it and rod 14 to the right as shown in the figures. Such movement forces spider cams 38 to the right, driving cam followers 50 up spider cam surfaces 40 and in turn forcing core engagers 48 radially outward to the extended position shown in FIG. 3. The total travel of cams 38 is about $\frac{3}{4}$ inch. In practice, the amount of expansion obtained will depend on the diameter of the surrounding core and the amount of force applied to drive unit 22. Maximum possible expansion is achieved when return spring 30 has been fully compressed and cap screw 32 has flattened belleville washer 34 against thrust washer 36.

To retract core engagers 48 and release the core, drive unit 22 is rotated counterclockwise and moves the rod to the left as shown in the figures, reversing the above-described operation. Ordinarily, return spring 30 aids the leftward rod movement, but even if spring 30 fails, and mechanical interference of some sort hinders the movement of the rod, drive screw 22 is mechanically attached to rod 14, and itself provides the necessary positive return (i.e., leftward in the Figs.) force.

When core engagers 48 tightened into engagement with a surrounding core, three sets of springs continuously load drive screw 22 (biasing it to the left as shown) and help insure that vibrations and the like will be damped out and that the drive screw will not loosen and retract; belleville washer 58 forces drive screw 22 axially away from socket 33; belleville washers 46 force shaft collar 42 (and hence rod 14) leftward; and a leftward force also is provided by spring 30. In addition to damping vibration and loading drive screw 22, washer 58 takes up play in the joint between screw 22 and socket 33.

The operation of the shafts of FIGS. 6–9 is essentially similar to that described above for the shaft of FIGS. 1–5; however, the ball-coupling of screw 122 to shaft 114 does not provide positive retraction of the rod. The ball-coupling is advantageous, however, in that the area of coupling contact between screw 122 and ball bearing 125 in rod 114 is small and effectively constant, regardless of bending of the shaft. Such point contact largely eliminates the potentially serious problem of rod rotation being transmitted to screw 122 (which could retract the screw and permit core engagement members 48 to retract also) during use.

Various other features of the shaft provide for efficient operation under relatively harsh operation conditions, such as the rapid rotation of the shaft when it is under a heavy load which may cause considerable flexing. Specifically, the direct coupling between drive screw 22, rod 14, and engagers 48 transmits significant force to the engagers and provides a high load-carrying capacity. Further, the use of belleville washers or elastomeric springs between collars 42 and their respective spider cams 38 permits slight variations in axial displacement of the two cams 38 of a core engagement section 17, thereby permitting one end of a core engagement member 48 of an engagement section to expand slightly farther than the other so that the member 48 will conform to the core of the roll being supported even though that core may be slightly irregular or the shaft bowed. The elastomeric cam spring 246 of FIG. 10 has a significantly lower spring constant than do belleville washers 46, and thus permits such variation even under relatively light load.

Similarly, the combination of both return spring 30 and a belleville washer 34 permits a person tightening the shaft to "feel" the increased resistance of the latter as full expansion is approached.

What is claimed is:

1. In an expansible shaft comprising:

an axially-extending housing:

a core engager movable radially relative to said housing between an expanded position in which said core engager extends beyond the outer wall of said housing and a retracted position in which said core engager is positioned radially within said expanded position thereof; and, an actuator arranged to cause said core engager to move towards and away from said retracted position and said expanded position in response to axial movement of said actuator;

said actuator having a first cam surface inclined with respect to said shaft axis, and a slot at one side of, radially outwardly of, and parallel to said first cam surface; and, said core engager having a radially inwardly projecting cam follower slidingly engaging said first cam surface, that improvement wherein:

said cam follower includes a cross-bore one end of which overlies and follows said slot as said surface of said cam follower slides along said first cam surface and a second bore which extends generally perpendicular to and intersects said cross-bore;

a first member is positioned within and forms a a slip-fit with said cross-bore so as to be movable axially of said cross-bore;

a second member is positioned within and movable axially of said second bore;

the end of said first member nearer said second bore is convex; and the length of said first member is such that when said second member is positioned within the intersection of said bores in engagement with a portion of said first member is forced to project from said cam follower into said slot, and when said second member is withdrawn from the intersection of said bores said first member may be positioned wholly within said cross-bore.

2. The shaft of claim 1 further characterized in that said end of said first member is defined by a portion of the surface of a sphere.

3. The shaft of claim 2 further characterized in that each of said members has a generally hemispherical surface at the end thereof adjacent the other of said members.

4. The shaft of claim 2 further characterized in that said first member is circular in cross-section and that the distance that said first member projects from said cam follower is in the range of about $\frac{1}{2}$ the radius of said first member to about the radius of said first member.

5. The shaft of claim 1 further characterized in that each of said members is a ball and the length of said cross-bore is less than the sum of the diameters of said balls.

6. The shaft of claim 1 further characterized in that said first member is a cylindrical rod having a generally hemispherical surface of the end thereof nearer said second bore.

7. The shaft of claim 1 further characterized in that said second bore contains a threaded screw axially movable therein between a first position in which said screw maintains said first member in position projecting into said slot, and a second position permitting said first member to be withdrawn wholly into said cross-bore.

8. The shaft of claim 7 further characterized in that said screw has a tapered end engaging said first member.

9. The shaft of claim 1 further characterized in that said cross-bore extends transversely the width of said cam follower, a said slot is provided adjacent each end of said cross-bore, and a pair of said first members are provided within said cross-bore, one of said first members being located on each side of the intersection of said bores.

10. The shaft of claim 9 further characterized in that each of said first members is circular in cross-section, and each of said slots is defined in cross-section by a circular arc of radius greater than that of said first member and having an arc height not greater than the radius of said first member.

11. The shaft of claim 9 wherein each of said members comprises a ball, all of said balls being of substantially the same diameter.

12. The shaft of claim 1 further characterized in that said first member is circular in cross-section, and said slot is defined in cross-section by an annular arc of radius greater than that of said first member and having an arc height not greater than the radius of said first member.

13. The shaft of claim 1 further characterized in that said core engager and said cam-follower comprise an integral unit.

14. The shaft of claim 1 wherein each of said members comprises a ball.

* * * * *